US009895040B2

(12) United States Patent
Canale

(10) Patent No.: US 9,895,040 B2
(45) Date of Patent: Feb. 20, 2018

(54) COMPACT TELESCOPIC EXTENSION FOR AN ELECTRIC HOUSEHOLD APPLIANCE AND ASSOCIATED ELECTRIC HOUSEHOLD APPLIANCE

(71) Applicant: OMEC S.p.A., Gorla Minore (VA) (IT)

(72) Inventor: Stefano Canale, Gorla Minore (IT)

(73) Assignee: OMEC S.P.A., Gorla Minore (VA) (IT)

( * ) Notice: Subject to any disclaimer, the term of this patent is extended or adjusted under 35 U.S.C. 154(b) by 0 days.

(21) Appl. No.: 15/439,195

(22) Filed: Feb. 22, 2017

(65) Prior Publication Data

US 2017/0245720 A1 Aug. 31, 2017

(30) Foreign Application Priority Data

Feb. 25, 2016 (IT) ..... 102016000019841

(51) Int. Cl.
*A47L 9/24* (2006.01)
*A47L 9/32* (2006.01)
*F16L 27/12* (2006.01)

(52) U.S. Cl.
CPC ..... *A47L 9/32* (2013.01); *F16L 27/12* (2013.01)

(58) Field of Classification Search
CPC ..... F16L 27/12
USPC ..... 285/7, 303, 298
See application file for complete search history.

(56) References Cited

U.S. PATENT DOCUMENTS 5,332,266 A * 7/1994 Canale ..... A47L 9/244 285/24
6,435,754 B1 8/2002 Canale
6,474,696 B1 * 11/2002 Canale ..... A47L 9/244 285/316
7,025,383 B2 4/2006 Canale
7,516,988 B2 * 4/2009 Lin ..... A47L 9/244 15/414
7,883,116 B2 2/2011 Canale
(Continued)

FOREIGN PATENT DOCUMENTS

DE 295 10 671 U1 11/1996
DE 20 2006 000 540 U1 3/2006
(Continued)

OTHER PUBLICATIONS

IT Search Report dated Oct. 24, 2016 in IT application 10201600019841 (UB20161063).

*Primary Examiner* — Aaron M Dunwoody
(74) *Attorney, Agent, or Firm* — Nixon & Vanderhye P.C.

(57) ABSTRACT

A telescopic extension, typically for an electric household appliance, comprises: an inner tube and an outer tube. The inner tube and the outer tube are slidable telescopically relative to one another. The inner tube comprises, on an outer surface thereof, a plurality of deformations of predetermined shape; a sleeve fitted inside the outer tube, at one of its ends; a constraining device configured to lock sliding of the inner tube with respect to the outer tube, when the constraining device is at least partially engaged in one of the deformations; a slider and elastic means, wherein the slider cooperates with the constraining device under the action of the elastic means; and an actuating device operatively connected to the slider. The slider comprises a guiding device for providing a guided movement between the slider and the constraining device.

8 Claims, 6 Drawing Sheets

(56) References Cited

U.S. PATENT DOCUMENTS

| | | | | |
|---|---|---|---|---|
| 2004/0051302 | A1* | 3/2004 | Canale | A47L 9/244 285/7 |
| 2010/0001511 | A1* | 1/2010 | Canale | A47L 9/244 285/7 |
| 2010/0123305 | A1* | 5/2010 | Shih | A47L 9/244 285/7 |
| 2013/0175794 | A1* | 7/2013 | Cordes | A47L 9/24 285/7 |
| 2015/0014985 | A1* | 1/2015 | Cordes | A47L 9/244 285/7 |

FOREIGN PATENT DOCUMENTS

| | | | |
|---|---|---|---|
| EP | 0 987 976 | B1 | 3/2002 |
| EP | 1 333 747 | B1 | 4/2006 |
| EP | 1 875 849 | A2 | 1/2008 |
| EP | 1 092 383 | B1 | 5/2008 |
| EP | 2 001 348 | B1 | 12/2009 |
| GB | 2 416 679 | A | 2/2006 |
| WO | WO 98/56289 | A1 | 12/1998 |
| WO | WO 02/18802 | A1 | 3/2002 |
| WO | WO 02/38026 | A1 | 5/2002 |
| WO | WO 2005/085659 | A1 | 9/2005 |

* cited by examiner

COMPACT TELESCOPIC EXTENSION FOR AN ELECTRIC HOUSEHOLD APPLIANCE AND ASSOCIATED ELECTRIC HOUSEHOLD APPLIANCE

This application claims priority to IT Patent Application No. 102016000019841 filed Feb. 25, 2016, the entire content of which is hereby incorporated by reference.

BACKGROUND

The present invention relates to a telescopic extension, in particular for an electric household appliance, such as a vacuum cleaner, a vacuum cleaner drum, an electric broom, a carpet beater, a cyclonic vacuum cleaner, for a centralized suction system or a similar apparatus. The present invention also relates to an electric household appliance comprising such a telescopic extension. The telescopic extension according to the invention is compact when in the closed configuration.

STATE OF THE ART

Known telescopic extensions for electric household appliances comprise an inner tube and an outer tube sealingly slidable inside one another, a sleeve, a constraining device able to rigidly connect together (lock) the inner tube and the outer tube, a push-action slider engaging with the constraining device under the action of elastic means, and an actuating device operationally connected to the push-action slider. In these known telescopic extensions, the inner tube is provided with a row of notches of predefined shape, and the sleeve is fixed to the outer tube. The constraining device and the push-action slider are movably supported in said sleeve. The elastic means are also housed inside said sleeve.

The push-action slider acts on the constraining device under the action of the elastic means. It forces the constraining device to remain inside one of the notches of the inner tube so as to lock the tube inside the outer tube.

The actuating device, in turn, is configured to disengage the push-action slider from the constraining device so as to leave the constraining device free to be move radially outside of the notch of the inner tube. In this way the inner tube is released from the outer tube and may be slid relative to the outer tube so as to adjust the length of the extension.

EP 1 092 383 and WO 02/38026 A1 describe telescopic extensions for electric household appliances.

Depending on the suction direction in a telescopic extension an input end and an output end are identified. The input end is typically removably fixed to a suction tool such as a so-called vacuum cleaner brush or vacuum cleaner nozzle. The brush slides over the surface to be cleaned and sucks up solids or liquids such as dust, debris, crumbs or water. The material sucked up from the ground enters into the telescopic extension through the input end and exits the telescopic extension through the output end. Downstream of the telescopic extension the material sucked up from the ground is collected, passing optionally through another tube, for example a rigid or flexible tube of the spiral type.

Similarly, depending on the suction direction, an input end and an output end are also identified for the inner tube and outer tube. In fact, the input end of the inner tube corresponds to the input end of the telescopic extension and the output end of the outer tube coincides with the output end of the telescopic extension.

In the known telescopic extensions the sleeve, the constraining device and the corresponding actuating device are located substantially in the proximity of the input end of the outer tube.

The vacuum cleaner is used by gripping the telescopic extension close to its output end and directing the suction tool towards the surface to be vacuumed. In order to slide the inner tube relative to the outer tube, the use must hold the inner tube with one hand. With the other hand the user must push (or pull) the pushbutton and push (or pull) the outer tube relative to the inner tube.

SUMMARY OF THE INVENTION

The inventor has defined the object of optimizing the length of a telescopic extension of the aforementioned type. In particular, the inventor has defined the object of providing a telescopic extension having a length smaller than that of the known extensions in the closed configuration (when the inner tube is fully inserted in the outer tube), while maintaining substantially the same length in the fully extended configuration. Alternatively, the inventor proposes the object of providing a telescopic extension which has a length substantially the same as that of the known extensions in the closed configuration (when the inner tube is fully inserted in the outer tube), but which has a greater length in the fully extended configuration.

In any case, a significant advantage is obtained. In particular, with a telescopic extension having a smaller length in the closed configuration it is possible to obtain a package with smaller dimensions, with all the associated logistical and cost-related advantages. If it is not required to reduce the length in the closed configuration, as a result of the present invention the user has available a longer telescopic extension suitable for taller persons or for reaching zones situated further away.

The inventor has realized that, in order to achieve the aforementioned objects, it is necessary to reduce the length of the sleeve.

However, reducing the length of the sleeve has resulted in an instability of the various components and a consequent unacceptable lack of precision during operation of the telescopic extension.

According to a first aspect of the present invention, a telescopic extension is provided, said telescopic extension comprising:

- an inner tube;
- an outer tube;
  - wherein said inner tube and said outer tube are telescopically slidable relative to one another;
  - wherein said inner tube comprises, on an outer surface thereof, a plurality of deformations of predetermined shape;
- a sleeve fitted inside said outer tube, at one of its ends;
- a constraining device configured to lock sliding of the inner tube with respect to the outer tube, when said constraining device is at least partially engaged in one of said deformations;
- a slider and elastic means, wherein said slider cooperates with said constraining device under the action of said elastic means; and
- an actuating device operatively connected to said slider,
- wherein said slider comprises a guiding device for providing a guided movement between said slider and said constraining device, wherein said slider comprises a substantially flat lower face and two side walls, wherein said guiding device comprises an inclined plane which is recessed with respect to the substantially flat lower face and is delimited by said side walls. Thanks to the above arrangement, the constraining device performs a guided movement which is laterally constrained by said side walls.

As said above, the inclined plane is delimited laterally by two side walls which provide stability in the direction perpendicular to the sliding plane.

Preferably, the side walls comprise surfaces which prolong the plane of the substantially flat face of the slider.

The substantially flat face of the slider is preferably configured to translate on a bottom surface of a longitudinal cavity in the sleeve.

Preferably the width of the inclined plane corresponds substantially to the width of the slider.

The slider may also comprise a guiding edge for the inclined plane.

The slider may comprise a hole for retaining at least a portion of said elastic means. Preferably the inclined plane starts from a position substantially corresponding to the bottom of the hole.

The sleeve preferably comprises a circular stiffening collar and a longitudinal rib configured to engage a corresponding opening at an input end of the outer tube.

According to another aspect, the present invention provides an electric household appliance comprising a telescopic extension as defined above and in the continuation of the present description, as well as in the drawings.

In the present description and the claims the expression "tube having a cross-section with a substantially constant diameter" is used to indicate that the tube does not have a deformed portion able to house the sleeve entirely or partly. However, there may be deformations in the tube which have a different function.

BRIEF DESCRIPTION OF THE DRAWINGS

The present invention will become clear from the following detailed description of examples of embodiments, to be read with reference to the accompanying drawings, in which.

DESCRIPTION OF EXAMPLES

Figures 1A, 1B:
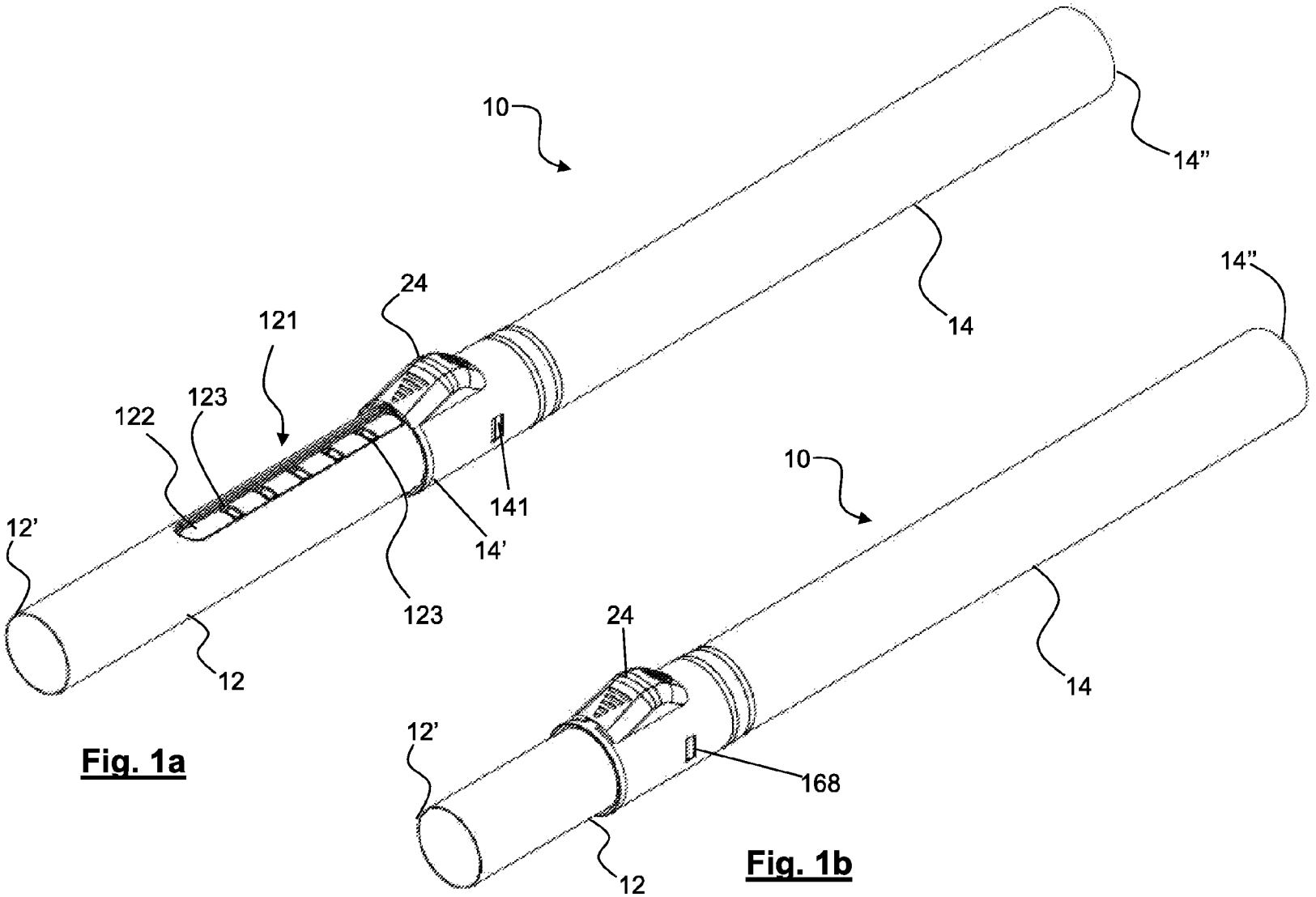
FIG. 1*a* is an axonometric view of a telescopic extension according to an embodiment of the invention in its partially extended configuration.
FIG. 1*b* shows the telescopic extension according to FIG. 1*a* in its closed configuration.
Figure 2:
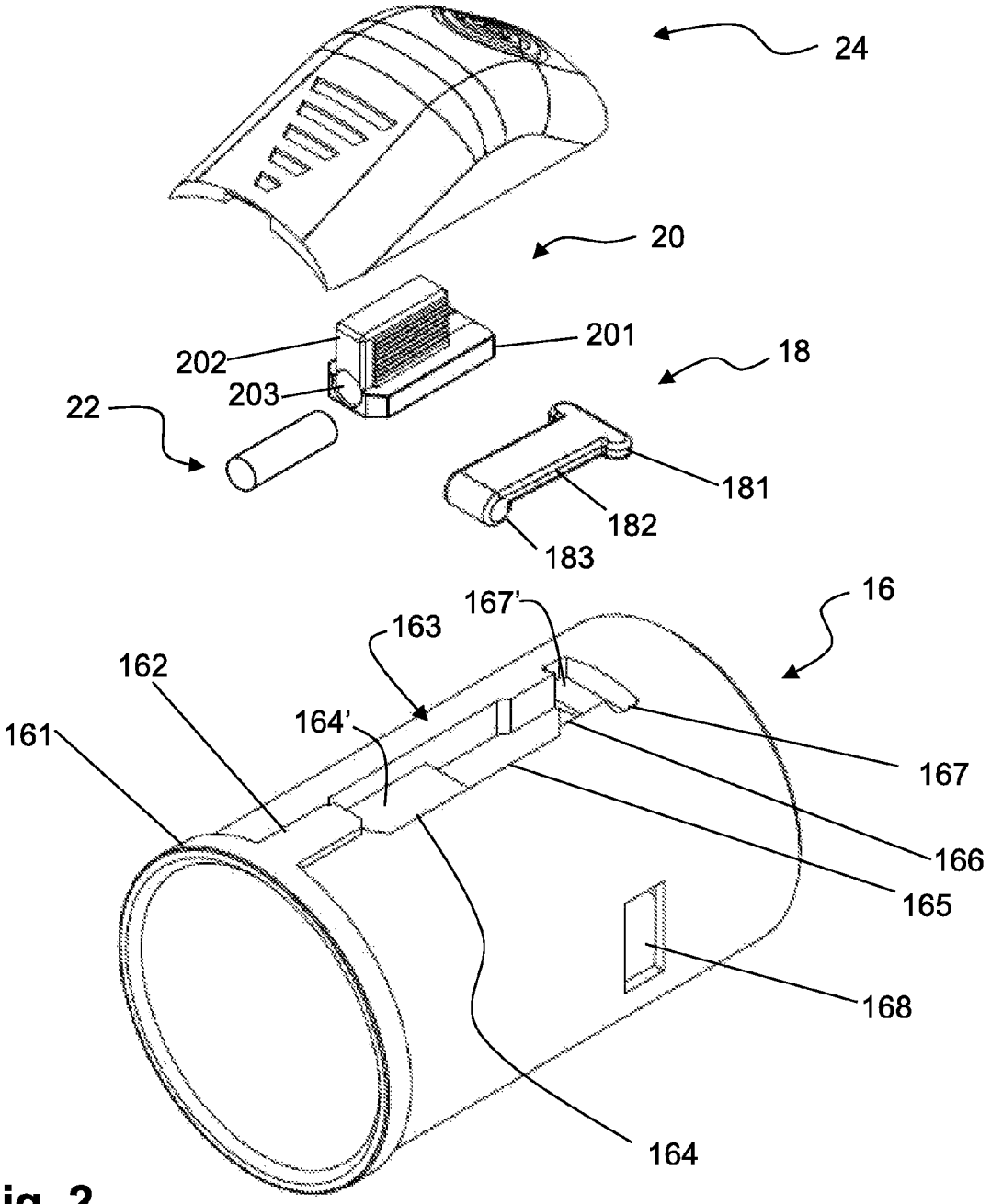
FIG. 2 shows an exploded view of the sleeve, the constraining device and other components.

FIGS. 1-3 show a telescopic extension 10 for an electric household appliance, such as a vacuum cleaner, according to an embodiment of the present invention. The extension 10 comprises an inner tube 12, an outer tube 14, a sleeve 16, a constraining member 18, a push-action slider 20, an elastic member 22 and an actuating device 24.

The inner and outer tubes 12 and 14 are sealingly slidable one inside the other one. Preferably a sealing gasket may be inserted between the inner tube 12 and the outer tube 14. The tubes 12 and 14 are, for example, made of chrome-plated stainless steel or painted externally. Alternatively they may be made of any metal.

The inner tube 12 has a first end (or input end) 12' and a second end (or output end) which is not visible in the figures. The outer tube 14 has a first end (or input end) 14' and a second end (or output end) 14". The telescopic extension 10 therefore has as input end the input end 12' of the inner tube 12 and as output end the output end 14" of the outer tube 14.

The inner tube 12 preferably has a longitudinal groove 121 which is substantially parallelepiped-shaped and has a bottom wall 122 in which a row of notches 123 is formed. Preferably, the notches 123 have a partially cylindrical shape and are configured to house a portion of the constraining member 18, as will be described below.

FIG. 2 is an exploded axonometric view of the sleeve 16, the constraining member 18, the slider 20, and the elastic member 22 of the actuating device 24.

The sleeve 16 is designed to be inserted inside the input end 12' of the outer tube 14. Preferably the sleeve 16 comprises a substantially cylindrical body with a circular stiffening collar 161 at its input end. The sleeve 16 also comprises, preferably, a longitudinal rib 162 configured to engage a corresponding opening at the input end 14' of the outer tube 14. This prevents the sleeve 16 from rotating with respect to the outer tube 14. Moreover the rib 162 increases locally the thickness of the sleeve 16.

Preferably the sleeve 16 comprises a longitudinal cavity 163. Preferably the longitudinal cavity 163 comprises, in succession, a first section 164 provided with bottom 164', a second open section 165, a third narrower open section 166 and a fourth section 167 with closed bottom 167'.

Preferably, the constraining member 18 comprises a T-shaped metal plate. The head 181 of the T is adapted to be inserted inside the fourth section 167 of the longitudinal cavity 163. The shank 182 of the T is adapted to be retained inside the third section 166 of the longitudinal cavity 163. The end 183 of the T is curled and forms a small cylinder 183. When the head 181 of the T is inserted inside the fourth section 167, the constraining member is free to rotate, as may be understood from a comparison of FIGS. 3*a* and 3*b*. The movement of the constraining member 18 will be described further in the continuation of the present description.

The slider 20 comprises a base 201 and a projecting part 202 configured to engage the actuating member 24 which may be for example a shaped button for pushing the slider in one direction or in the opposite direction.

The slider 20 also comprises a hole 203 in its rear part for receiving one end of the elastic member 22.

The actuating member 24 comprises a housing cooperating with the projecting part 202 so as to connect the actuating member substantially rigidly together with the slider 20.

Preferably the sleeve 16 also comprises one or more windows 168 for cooperating with one or more corresponding sawteeth 141 present in the wall of the outer tube 14 and for locking the sleeve to the outer tube, preventing it from becoming detached. Preferably there are two windows 168, which are situated diametrically opposite each other, and two sawteeth 141.

With reference to FIG. 4, the slider 20 will now be described in greater detail.

The base 201 has substantially a parallelepiped shape. Preferably, the rear end has chamfered corners 204 and the aforementioned blind hole 203 for receiving one end of the elastic member 22. Preferably the elastic member 22 is in the form of a helical spring.

The lower face of the base forms a substantially flat surface 205. However, one part thereof is provided with a ramp having an inclined plane 206. In particular it is provided with an inclined plane which is open towards the front end (opposite to that where the hole 203 for the spring is present). Preferably, the entrance area of the inclined plane has a different inclination and forms a guiding surface 207. Preferably the inclined plane is inclined with respect to the lower face of the base at an angle of between about 5 degrees and about 10 degrees. Preferably it is equal to about 7-8 degrees. Preferably the inclined plane 206 starts from a position substantially corresponding to the bottom of the hole 203 as shown in the cross-section of FIG. 4*b*.

Preferably there are two guiding side walls 208 along the sides of the inclined plane. The side walls 208 delimit laterally the inclined plane and prolong (with surfaces 208') the substantially flat surface of the lower face. Therefore the lower face has a U shape formed with the surface 205 and the two surfaces 208'.

The width of the inclined plane 206 substantially corresponds to the width of the shank 182 of the constraining member 18. Owing to the side walls, the shank 182 remains guided during its translatory movement.

Hereinbelow operation of the telescopic extension 10 according to the present invention will be described with reference in particular to FIGS. 3*a* and 3*b*.

Figure 3A:
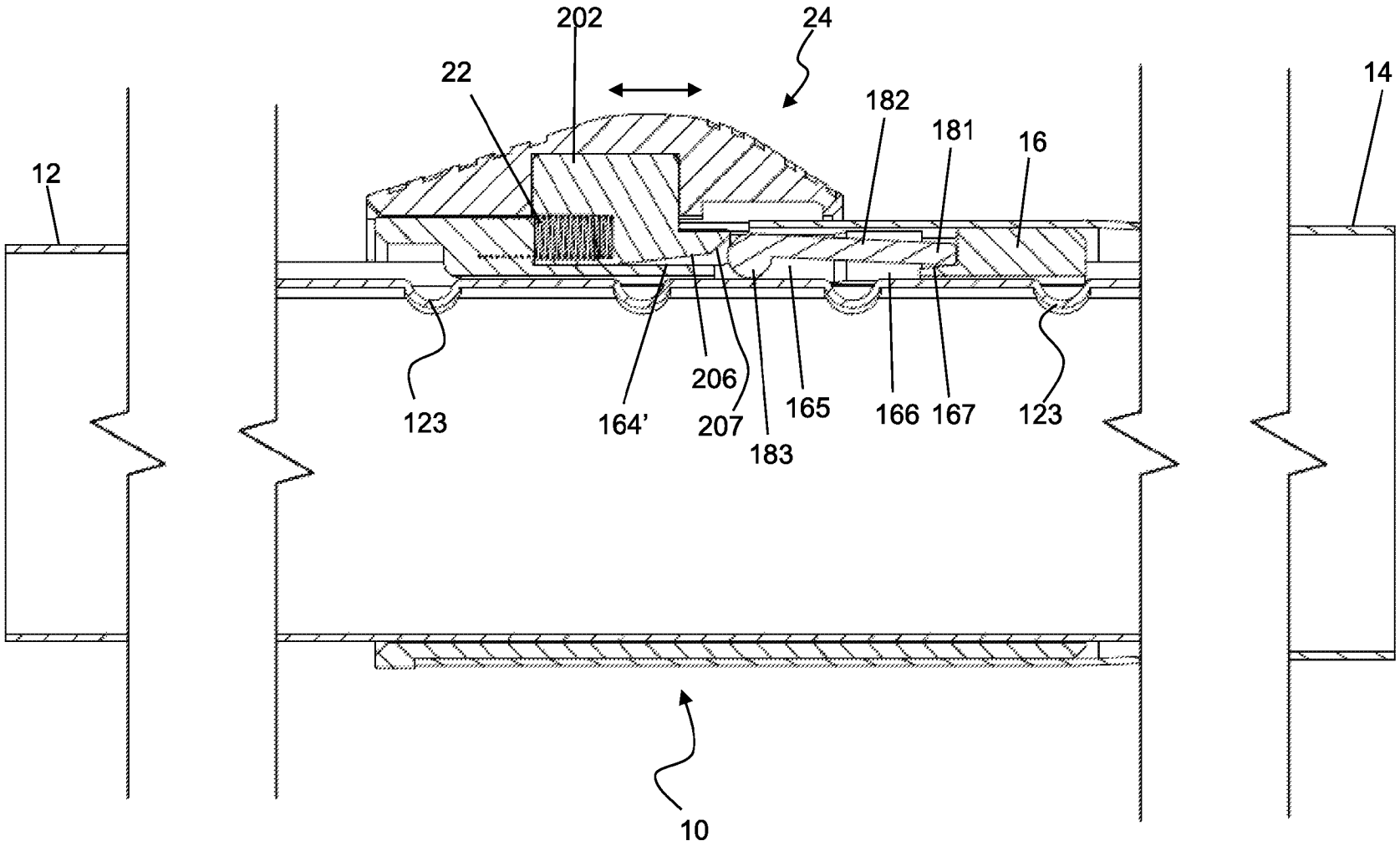
FIG. 3*a* shows a portion of the telescopic extension with the inner tube and the outer tube slidable relative to each other.

In the configuration shown in FIG. 3*a* the spring 22 is compressed as a result of the user pressing the actuating device 24 towards the input end of the telescopic extension. In this position, the constraining member 18 is not acted on by the slider 20 and in particular does not engage the inclined plane. Therefore, in this position, the curled end 183 of the constraining member 18 does not engage any of the notches 123. During a further sliding movement of the outer tube with respect to the inner tube, when the curled end 183 of the constraining member 18 is located opposite one of the notches 123, it passes beyond it. In other words, when the constraining member is not locked, the end 183 and the notches 123 do not form obstacles.

As can be understood, the head 181 of the constraining member 18 remains within the cavity 167. The constraining member 18 therefore performs a rotational movement about an axis substantially coinciding with the axis of the head 181.

Figure 3B:
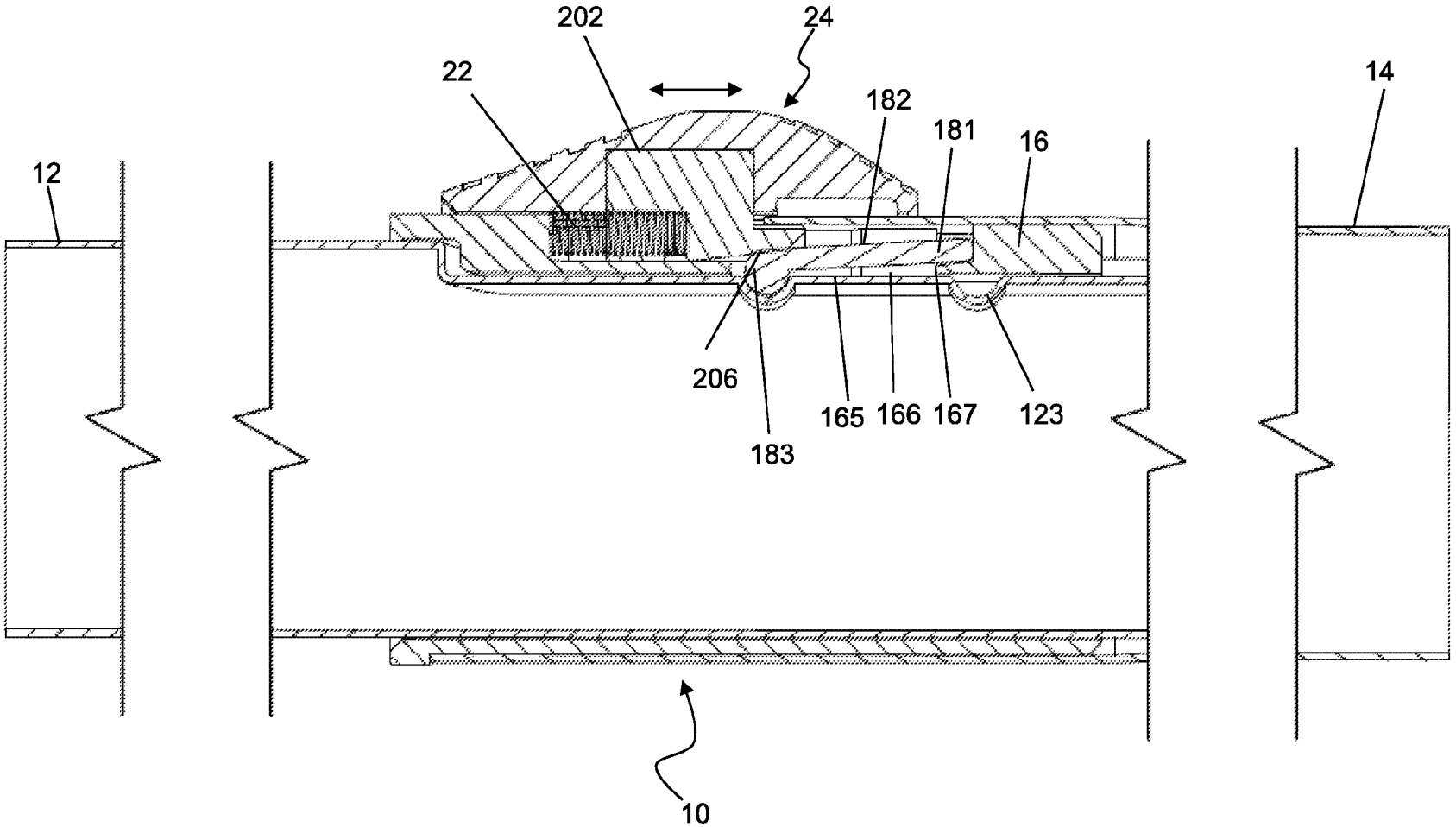
FIG. 3*b* shows a portion of the telescopic extension with the inner tube and the outer tube locked relative to each other.
Figure 4C:
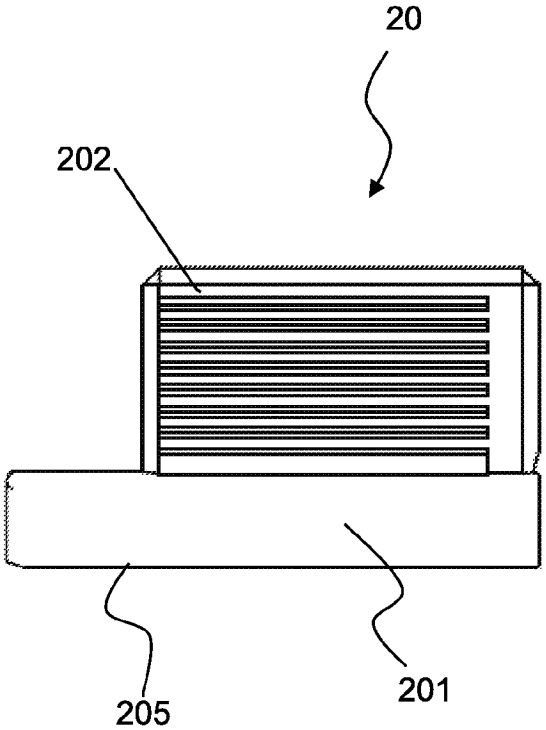
FIGS. 4*a*, 4*b*, 4*c*, 4*d* and 4*e* show various views of the slider of the telescopic extension according to an embodiment of the present invention.
Figure 4B:
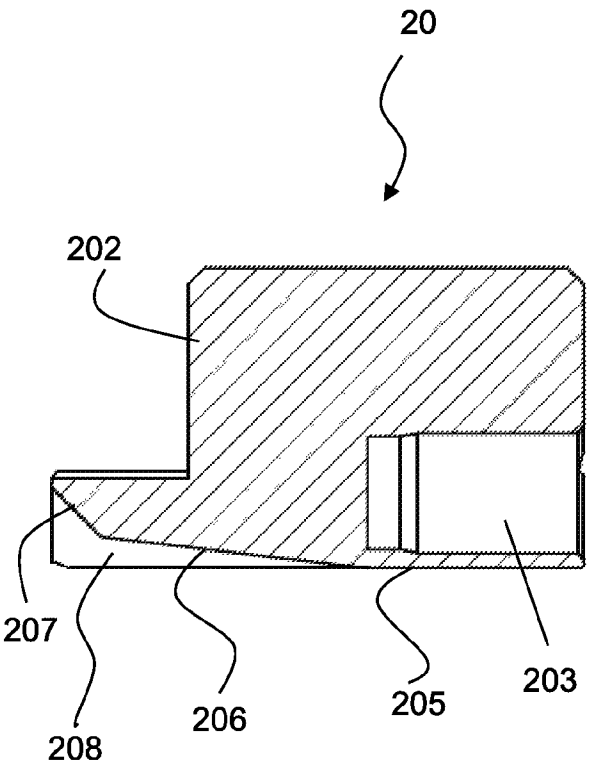
Figure 4A:
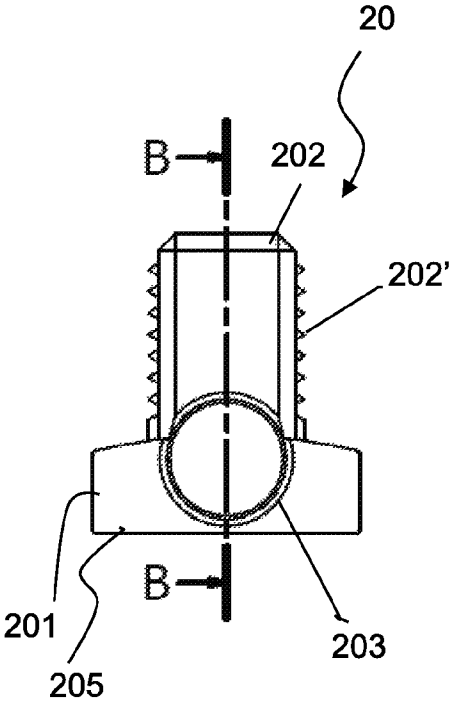
Figure 4D:
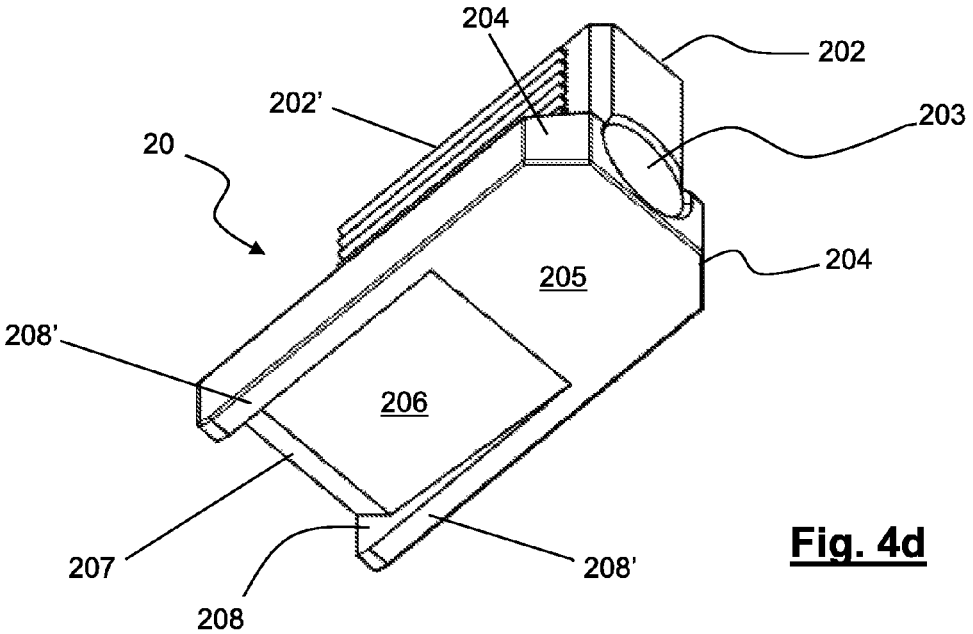
Figure 4E:
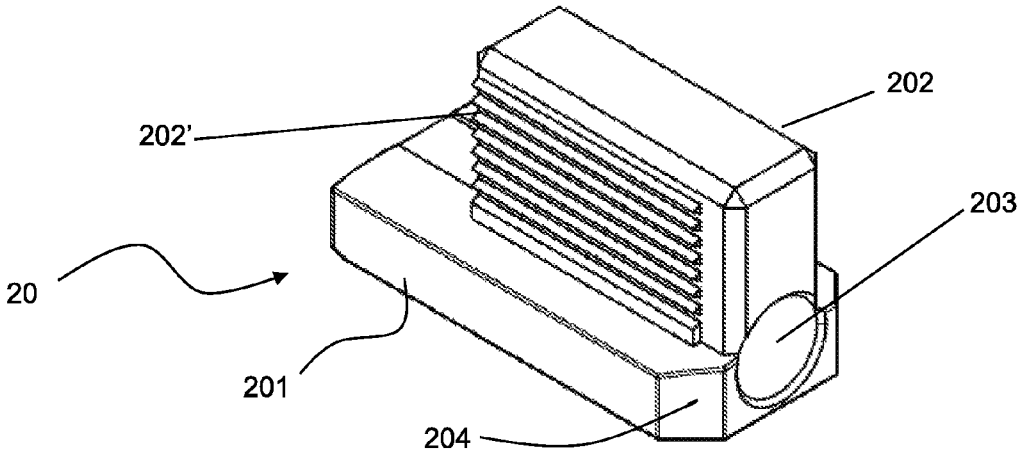

FIG. 3*b* shows the configuration where the outer tube 14 and the inner tube 12 are locked to each other and cannot slide relative to each other. In this position the actuating member 24 is no longer operated by the user and the spring 22 pushes the slider 20 towards the output end of the telescopic extension 10. In this position, the constraining member 18 is acted on by the slider 20 so that the curled end 183 is partly housed inside one of the notches 123. In this position the upper face of the constraining member 18 makes contact with the inclined plane 206 of the slider 20. As a result of the spring 22, the position shown in FIG. 3*b* is a stable position. The shank 182 of the constraining member 18 is retained laterally during its movement so as to make contact with the inclined plane 206. The retaining action is obtained by means of the side walls 208 situated along the sides of the inclined plane.

The sliding movement of the slider 20 is also stable and guided by the side walls of the first section 164 of the longitudinal cavity 163 and by the bottom 164'. It should be emphasized that the surface 205 and the surfaces 208' of the side walls slide on the bottom 164' of the section 164. This ensures a stable and precise movement and at the same time reduces the friction between the bottom 164' of the section 164 and the bottom face of the slider 20.

The sleeve according to the present invention has a smaller length than that of the known sleeves. This allows the mechanism for locking together the outer tube and the inner tube to be situated closer to the input end of the outer tube. This makes it possible to have a first locking notch situated close to the end of the outer tube. The outer tube may therefore be about 20-30 mm shorter than the known tubes if the object is to have a telescopic tube which is shorter in the closed configuration (while maintaining the same length when extended). Alternatively, as a result of the present invention, for the same dimensions in the closed configuration, the telescopic extension according to the invention is longer than the known telescopic extensions in the completely extended configuration. The maximum length is increased by about 20-30 mm. This length corresponds to a percentage which varies from 3% to 10% depending on the models. This percentage increases on models which have a smaller extended length. For example, it is about 10% in the case of relatively short telescopic extensions (200-300 mm).

The invention claimed is:

1. A telescopic extension comprising:

a) an inner tube;

b) an outer tube, wherein said inner tube and said outer tube are telescopically slidable relative to one another, wherein said inner tube comprises, on an outer surface thereof, a plurality of deformations of predetermined shape;

c) a sleeve fitted inside said outer tube, at one of its ends;

d) a constraining device configured to lock sliding of the inner tube with respect to the outer tube, when said constraining device is at least partially engaged in one of said deformations;

e) a slider and elastic means wherein said slider cooperates with said constraining device under the action of said elastic means; and f) an actuating device operatively connected to said slider, wherein said slider comprises a guiding device for providing a guided movement between said slider and said constraining device, wherein said slider comprises a substantially flat lower face and two side walls, wherein said guiding device comprises an inclined plane which is recessed with respect to the substantially flat lower face and is delimited by said side walls.

2. The telescopic extension according to claim 1, wherein said side walls comprise surfaces which prolong the plane of the substantially flat lower face of the slider.

3. The telescopic extension according to claim 2, wherein said substantially flat lower face of the slider is configured to translate on a bottom surface of a longitudinal cavity in said sleeve.

4. The telescopic extension according to claim 1, wherein a width of said inclined plane corresponds substantially to a width of said slider.

5. The telescopic extension according to claim 1, wherein said slider also comprises a guiding edge for said inclined plane.

6. The telescopic extension according to claim 1, wherein said slider comprises a hole for retaining at least a portion of said elastic means and wherein the inclined plane starts from a position substantially corresponding to the bottom of the hole.

7. The telescopic extension according to claim 1, wherein said sleeve comprises a circular stiffening collar and a longitudinal rib configured to engage a corresponding opening at an input end of the outer tube.

8. An electric household appliance comprising a telescopic extension according to claim 1.

* * * * *